US009360802B2

(12) United States Patent
Furukata et al.

(10) Patent No.: US 9,360,802 B2
(45) Date of Patent: Jun. 7, 2016

(54) IMAGE FORMING APPARATUS

(71) Applicant: FUJI XEROX CO., LTD., Tokyo (JP)

(72) Inventors: Hiroko Furukata, Kanagawa (JP); Yasutaka Goto, Kanagawa (JP); Yuki Kubota, Tokyo (JP); Takuya Kobayashi, Kanagawa (JP); Satoshi Tanaka, Kanagawa (JP); Noribumi Sato, Kanagawa (JP); Keiichi Okada, Kanagawa (JP); Junichi Uchiyama, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 14/604,292

(22) Filed: Jan. 23, 2015

(65) Prior Publication Data

US 2016/0026117 A1 Jan. 28, 2016

(30) Foreign Application Priority Data

Jul. 28, 2014 (JP) ..... 2014-152699

(51) Int. Cl.

| | |
|---|---|
| ***G03G 15/09*** | (2006.01) |
| ***G03G 15/095*** | (2006.01) |
| ***G03G 15/01*** | (2006.01) |
| *B41J 2/01* | (2006.01) |
| *G03G 15/08* | (2006.01) |
| *G03G 19/00* | (2006.01) |

(52) U.S. Cl.

CPC ..... *G03G 15/095* (2013.01); *G03G 15/0126* (2013.01); *B41J 2/01* (2013.01); *G03G 15/082* (2013.01); *G03G 15/0898* (2013.01); *G03G 19/00* (2013.01)

(58) Field of Classification Search

CPC ..... G03G 15/095

USPC ..... 399/264

See application file for complete search history.

(56) References Cited

U.S. PATENT DOCUMENTS

| | | | | |
|---|---|---|---|---|
| 3,441,505 | A * | 4/1969 | Schmiedel | G03G 9/09775 106/31.64 |
| 7,992,993 | B2 * | 8/2011 | Hiroki | B41J 13/0045 347/101 |
| 2007/0140738 | A1 * | 6/2007 | Aruga | G03G 15/095 399/237 |
| 2008/0165220 | A1 * | 7/2008 | Hiroki | B41J 2/16508 347/30 |
| 2008/0165242 | A1 * | 7/2008 | Hiroki | B41J 13/009 347/104 |
| 2015/0035889 | A1 * | 2/2015 | Nakano | H04N 1/4057 347/15 |

FOREIGN PATENT DOCUMENTS

| | | | | |
|---|---|---|---|---|
| JP | 2005-014420 | * | 1/2005 | B41J 2/01 |
| JP | 2005-14420 | A | 1/2005 | |

* cited by examiner

*Primary Examiner* — Clayton E LaBalle
*Assistant Examiner* — Kevin Butler
(74) *Attorney, Agent, or Firm* — Sughrue Mion, PLLC

(57) ABSTRACT

An image forming apparatus includes an image forming device that forms an image on a recording medium with a powdery material, the image being sized so as to extend beyond an edge of the recording medium; a collecting device that collects the material that has extended off the recording medium as a result of the image forming device forming the image; and a restricting unit that controls the image forming device in such a manner that the image forming device reduces an amount of use of the material in a region of the image that extends off the recording medium to a larger degree on an outer side of the image than a side of the image near the recording medium.

7 Claims, 4 Drawing Sheets

IMAGE FORMING APPARATUS

CROSS-REFERENCE TO RELATED APPLICATIONS

This application is based on and claims priority under 35 USC 119 from Japanese Patent Application No. 2014-152699 filed Jul. 28, 2014.

BACKGROUND (i) Technical Field

The present invention relates to image forming apparatuses.

(ii) Related Art

Frameless images, which are images extended up to the edge of a print sheet, are known.

SUMMARY

According to an aspect of the invention, an image forming apparatus includes an image forming device that forms an image on a recording medium with a powdery material, the image being sized so as to extend beyond an edge of the recording medium; a collecting device that collects the material that has extended off the recording medium as a result of the image forming device forming the image; and a restricting unit that controls the image forming device in such a manner that the image forming device reduces an amount of use of the material in a region of the image that extends off the recording medium to a larger degree on an outer side of the image than a side of the image near the recording medium.

BRIEF DESCRIPTION OF THE DRAWINGS

Exemplary embodiments of the present invention will be described in detail based on the following figures, wherein.

DETAILED DESCRIPTION

Figure 1:
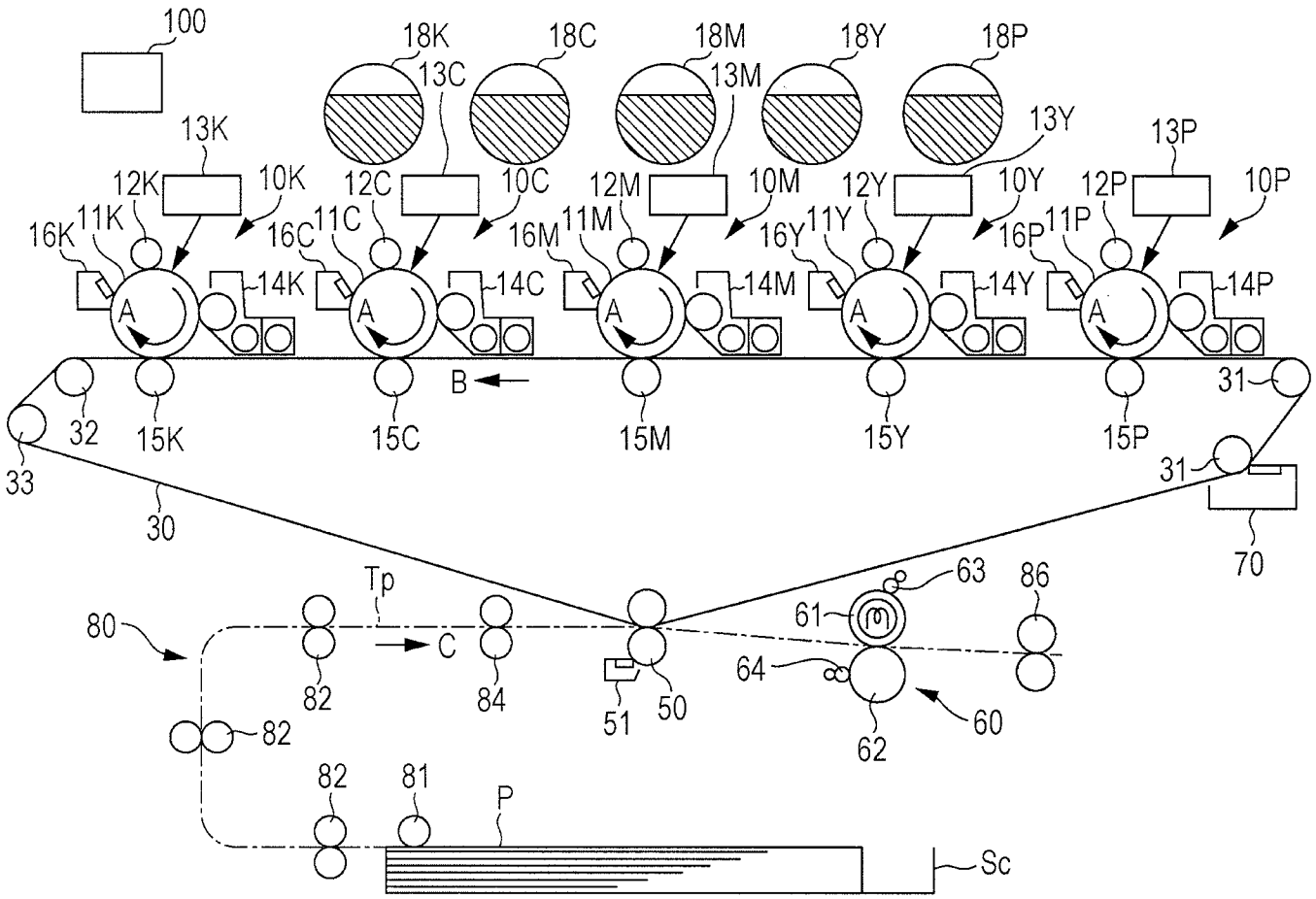
FIG. 1 is a schematic diagram of a configuration of a printer, corresponding to a specific first exemplary embodiment of an image forming apparatus.

A developing device and an image forming apparatus according to exemplary embodiments of the invention are described below referring to the drawings.

FIG. 1 is a schematic diagram of the configuration of a printer corresponding to an image forming apparatus according to a first exemplary embodiment.

An image forming apparatus 1 illustrated in FIG. 1, is a tandem color printer including image forming units 10Y, 10M, 10C, and 10K corresponding to yellow (Y), magenta (M), cyan (C), and black (K) arranged parallel with one another. The image forming apparatus 1 prints single-color images as well as full-color images containing four-color toner images. The image forming apparatus 1 also includes an optional image forming unit 10P arranged parallel with the YMCK image forming units 10Y, 10M, 10C, and 10K and at the upstream most position of all the image forming units. The optional image forming unit 10P is used to express a color other than YMCK colors, such as white, gold, or transparent, so that the image is capable of expressing various distinctions including granularity, fine quality, contrast enhancement, or embossing effect. In this embodiment, the optional image forming unit 10P is used to express "transparency" (and colorlessness).

The image forming apparatus 1 includes toner cartridges 18Y, 18M, 18C, 18K, and 18P that accommodate toner of YMCK colors and the color corresponding to the optional image forming unit 10P.

The four image forming units 10Y, 10M, 10C, and 10K and the optional image forming unit 10P have the same configuration apart from developers accommodated therein. Thus, the image forming unit 10Y corresponding to yellow is described as a typical example. When image forming units or their components are collectively described below, alphabets appended to the reference numerals of the image forming units or their components are omitted regardless of color and the image forming units are simply referred to as, for example, image forming units 10.

The image forming unit 10Y includes a photoconductor 11Y, a charging device 12Y, an exposing device 13Y, a developing device 14Y, a first transfer device 15Y, and a photoconductor cleaner 16Y.

The photoconductor 11Y rotates in the direction A illustrated in FIG. 1. The charging device 12Y, the exposing device 13Y, the developing device 14Y, the first transfer device 15Y, and the photoconductor cleaner 16Y are arranged in this order around the photoconductor 11Y.

The charging device 12Y charges the surface of the photoconductor 11Y. The exposing device 13Y exposes the surface of the photoconductor 11Y to light on the basis of an image signal supplied from an image processor 100 to form an electrostatic latent image. The developing device 14Y develops the latent image on the surface of the photoconductor 11Y using a developer containing toner into a toner image. The developing device 14Y is supplied by the toner cartridge 18Y with an amount of toner suitable for consumption. The first transfer device 15Y electrostatically transfers the toner image on the photoconductor 11Y to an intermediate transfer belt 30. The photoconductor cleaner 16Y includes a cleaning blade that comes into contact with and rubs against the surface of the photoconductor 11Y to clean the surface of the photoconductor 11Y after the transfer.

The image forming apparatus 1 includes an intermediate transfer belt 30, a fixing device 60, a sheet transporting unit 80, and an image processor 100. The intermediate transfer belt 30 is wound around belt support rollers 31 to 35 and rotationally moves in the direction of the arrow B so as to pass by the optional image forming unit 10P, the image forming units 10Y, 10M, 10C, and 10K, and a second transfer device 50. Toner images of the respective colors from the optional image forming unit 10P and the image forming units 10Y, 10M, 10C, and 10K are transferred to the intermediate transfer belt 30 so as to be superposed on one another. The intermediate transfer belt 30 moves while carrying a color toner image formed of these superposed color toner images. The second transfer device 50 has a structure in which a polyimide tube covers a roller made of expanded rubber. The second transfer device 50 electrostatically transfers the toner image on the intermediate transfer belt 30 to a sheet.

A combination of the four image forming units 10Y, 10M, 10C, and 10K, the optional image forming unit 10P, the intermediate transfer belt 30, the second transfer device 50, and the fixing device 60 corresponds to an example of an image forming device according to an exemplary embodiment of the invention and toner corresponds to an example of a powdery material according to an exemplary embodiment of the invention.

A belt cleaner 70 has a blade, which is brought into contact with the intermediate transfer belt 30 to scrape the toner off the surface of the intermediate transfer belt 30. The second transfer device 50 also includes a transfer-device cleaner 51 that has a blade, which is brought into contact with the surface of the second transfer device 50 to scrape the toner off the surface.

The fixing device 60 fixes toner onto a sheet. The fixing device 60 includes a heating roller 61 and a pressing roller 62. The heating roller 61 includes a heating device installed therein. The heating roller 61 and the pressing roller 62 causes a sheet carrying an unfixed toner image to pass therethrough to fix a toner image onto the sheet while squeezing the sheet from both sides. The fixing device 60 also includes fixing-device cleaners 63 and 64, which remove toner from the surfaces of the heating roller 61 and the pressing roller 62, respectively.

The transfer-device cleaner 51 and the fixing-device cleaners 63 and 64 correspond to examples of a collecting device according to an exemplary embodiment of the present invention.

The sheet transporting unit 80 transports sheets along a sheet transport path TP along which the sheets pass by the second transfer device 50 and the fixing device 60. The sheet transporting unit 80 picks up sheets contained in a sheet container SC using a pick-up roller 81, transports the sheets using transport rollers 82, and feeds the sheets to the second transfer device 50 using registration rollers 84. The sheet transporting unit 80 also ejects the sheets to the outside using ejection rollers 86.

The image processor 100 processes data of an original image captured from a device such as an external personal computer or a scanner to generate image signals for respective colors and transfers the respective image signals to the image forming units 10 of the corresponding colors. For generating image signals corresponding to respective colors, the image processor 100 executes screen processing to reproduce a halftone image with dots. Upon receipt of an instruction from a user through a user interface, not illustrated, the image processor 100 executes processing such as removal of a background color or frameless printing for forming an image so sized as to fully expand throughout the entire sheet.

In the frameless printing, the image forming unit 10 forms a toner image having a size slightly larger than the sheet size. Thus, the edge portion of the toner image extends off the sheet and the toner in the edge portion is later collected by the transfer-device cleaner 51 or the fixing-device cleaners 63 and 64. The amount of toner collected in the frameless printing is larger than the amount of toner collected in normal printing other than the frameless printing. The amount of toner collectable by collecting devices such as the transfer-device cleaner 51 or the fixing-device cleaners 63 and 64 is limited. When the amount of the collected toner arrives at the upper limit, the life of the image forming apparatus 1 is exhausted and the image forming apparatus 1 requires recovery operations such as maintenance. In other words, frameless printing shortens the life of the image forming apparatus 1 compared to normal printing. Moreover, if the amount of toner that extends off a sheet is large, some amount of toner may adhere to the edge of the sheet due to melting while being fixed and cause matter protruding from the edge of the sheet, impairing the appearance of the edge. For the purposes of preventing shortening of the apparatus life caused by frameless printing or for other purposes, the image forming apparatus 1 according to the embodiment reduces the amount of collected toner. Now, the function of reducing the amount of collected toner is described below.

Figure 2:
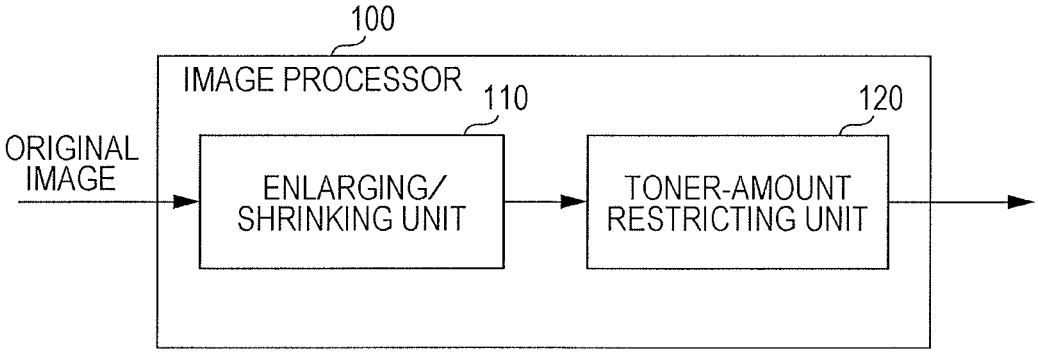
FIG. 2 is a functional block diagram illustrating the functions of an image processor at the time of frameless printing.

FIG. 2 is a functional block diagram illustrating the functions of an image processor at the time of frameless printing.

As a functional structure at the time of frameless printing, the image processor 100 includes an enlarging/shrinking unit 110 and a toner-amount restricting unit 120.

The enlarging/shrinking unit 110 converts an original image to an image having a size slightly larger than a sheet size by enlarging or reducing the size of the original image. Here, the "size slightly larger than a sheet size" in this embodiment is a size that allows for misalignment of the toner image and the sheet that may be caused by, for example, sheet transport errors or toner-image transfer errors occurring in the sheet transporting unit 80. This size is the minimum size that allows the edge portion of the sheet to be prevented from remaining white even when the toner image and the sheet are misaligned with each other.

The toner-amount restricting unit 120 restricts the amount of use of toner at an outer edge portion of the toner image. The toner-amount restricting unit 120 corresponds to an example of a restricting unit according to an exemplary embodiment of the invention.

Figure 3:
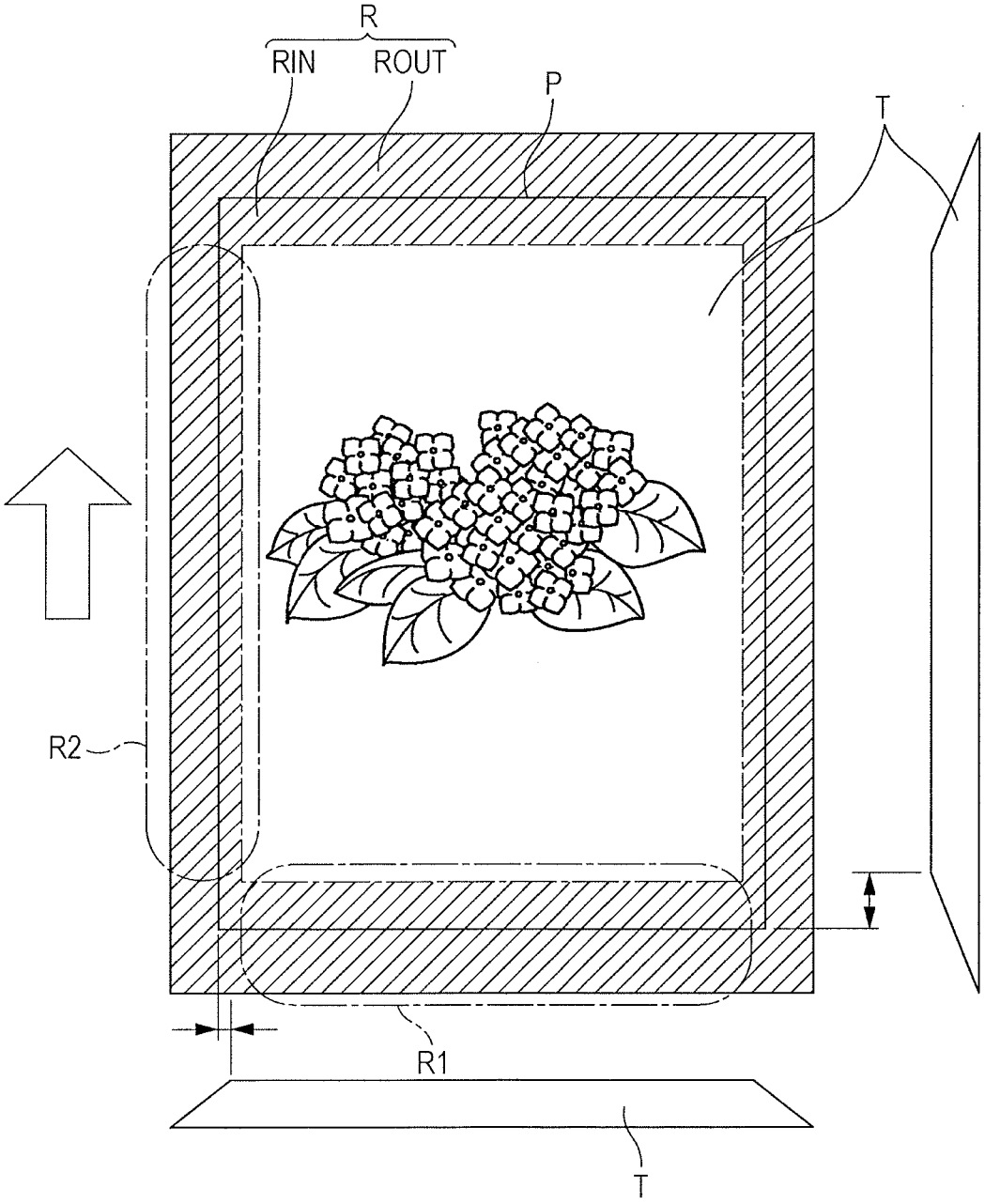
FIG. 3 is a schematic diagram illustrating restriction on the amount of use of toner imposed by a toner-amount restricting unit.

FIG. 3 is a schematic diagram illustrating restriction of the amount of use of toner imposed by the toner-amount restricting unit.

In FIG. 3, for convenience of illustration, probable misalignment of a toner image T and a sheet P is exaggeratingly drawn.

As described above, the size of the toner image T is larger than the size of the sheet P so that the entire surface of the sheet T is covered by the toner image T even in the case where the toner image T is misaligned with respect to the sheet P. In other words, the size of the toner image T is restricted to such a degree that the edge of the toner image T is positioned just within the edge of the sheet P when the toner image T and the sheet P have maximum misalignment.

An outer edge portion of the toner image T includes a toner-amount restricted region R, in which a toner image is formed at a density calculated by multiplying the image density of the original image by a toner use rate. The toner use rate in a region inward of the toner-amount restricted region R is 100%, which means that the amount of use of toner is not restricted at all in this region. In other words, the toner image is formed at the image density corresponding to the data of the original image.

The toner use rate in the toner-amount restricted region R linearly changes from 100% at the innermost edge of the toner-amount restricted region R to 0% at the outermost edge of the toner-amount restricted region R. In other words, the restriction on the amount of use of toner is increasingly tightened toward the outer edge of the toner-amount restricted region R. Thus, the amount of toner that has failed to be transferred to the sheet P among the toner forming the entire toner image T and that is then collected is reduced, and the reduction of the amount of toner enables minimization of shortening of the apparatus life. The toner that has failed to be transferred to the sheet P is reworded as toner left off the sheet P or toner falling out of the sheet P and includes toner that has been transferred to a portion out of the sheet at the transfer operation and toner that has flowed out of the sheet as a result of melting at the fixing operation.

In the exemplary embodiment, the restriction on the amount of use of toner is linearly tightened in view of the image density. Thus, the color or other characteristics of the image inside the toner-amount restricted region R is natural and the appearance of the image is not impaired.

On the bottom and the right of FIG. 3, cross-sectional diagrams schematically expressing the restriction on the amount of use using the thickness of the toner image T are shown. The cross-sectional diagram taken along the direction of the arrow in FIG. 3 in which the sheet is transported is shown on the right and the cross-sectional diagram taken along the direction perpendicular to the direction in which the sheet is transported is shown on the bottom. The thickness of the toner image T illustrated in the cross-sectional diagrams is zero at both ends of the toner image T and largest at the position corresponding to the innermost edge of the toner-amount restricted region R. The thickness of an actual toner image is also dependent on the image density. The thickness of the toner image T illustrated in FIG. 3 corresponds to the thickness in the case of a solid image.

In this embodiment, the toner-amount restricted region R includes an outer region ROUT extending off the sheet P and an inner region RIN extending within the sheet P. Since the restriction on the amount of use of toner is imposed also on the inner region RIN, the amount of toner collected after having failed to be transferred to the sheet P is reduced compared to the case where restriction on the amount of use of toner is only imposed on the outer region ROUT. Thus, shortening of the apparatus life is minimized.

The restriction on the amount of use in the inner region RIN, which is located on the leading side of the sheet P in the direction in which the sheet P is transported, facilitates separation of the sheet P when the sheet P passes through the fixing device 60 illustrated in FIG. 1.

In this embodiment, restriction on the amount of use of toner is tighter in first regions R1, extending on both sides of the edges of the sheet P in the transportation direction, than in second regions R2, extending on both sides of the edges of the sheet P in the width direction perpendicular to the transportation direction. Specifically, the distance between the innermost edge of each first region R1 and the edge of the sheet P in the first region R1 is longer than the distance between the innermost edge of each second region R2 and the edge of the sheet P in the second region R2. Thus, each first region R1 is larger than each second region R2 and restriction on the amount of use of toner is tighter in the first regions R1 than in the second regions R2. This is because, since the degree of misalignment of the sheet P and the toner image T in the transportation direction is larger than that in the width direction, the toner image T is sized so as to extend off the sheet P to a larger degree in the transportation direction that in the width direction, so that the amount of toner that fails to be transferred to the sheet P is larger in a portion extending in the transportation direction than in a portion extending in the width direction. For convenience of illustration, FIG. 3 only shows one of the first regions R1 and one of the second regions R2 of the sheet P, but actually, the first regions R1 are located on opposing sides of the sheet P and the second regions R2 are located on opposing sides of the sheet P.

The image forming apparatus according to an exemplary embodiment of the invention may be structured so as to, for example, restrict only the amount of use of "transparent" (and colorless) toner, corresponding to the optional image forming unit 10P, but not to restrict the amount of use of YMCK color toners. However, the image forming apparatus 1 according to the exemplary embodiment restricts both amounts of use of colorless and color toner. Nevertheless, the degree of restriction imposed on colorless toner and that on color toner are different from each other.

Figure 4:
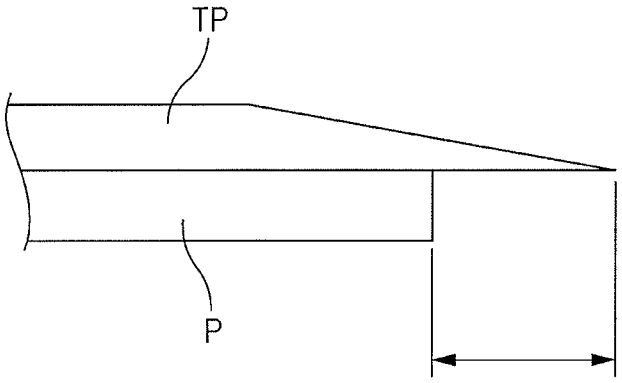
FIG. 4 is a schematic diagram illustrating restriction on the amount of use of "transparent" toner.
Figure 5:
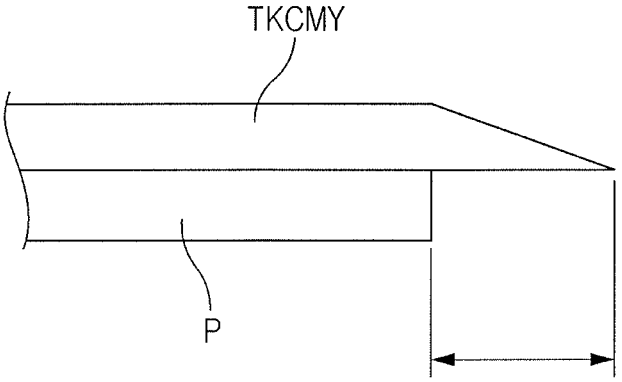
FIG. 5 is a schematic diagram illustrating restriction on the amount of use of color toner.

FIG. 4 is a schematic diagram illustrating the restriction on the amount of use of "transparent" toner and FIG. 5 is a schematic diagram illustrating the restriction on the amount of use of color toner.

FIG. 4 schematically illustrates the state of a toner layer TP of "transparent" toner formed on the sheet P viewed from one side of the sheet P. FIG. 5 schematically illustrates the state where a toner layer TKCMY of color toner formed on the sheet P viewed from one side of the sheet P. Actually, the toner layer TKCMY of color toner and the toner layer TP of "transparent" toner are superposed. However, for convenience of illustration, the toner layers TP and TKCMY are separately illustrated in FIGS. 4 and 5.

Both of the toner layer TP of "transparent" toner and the toner layer TKCMY of color toner are so sized as to extend beyond the edge of the sheet P. The outer edges of these toner layers TP and TKCMY are positioned at the outer edge of the range covering the maximum misalignment of the sheet P and the toner layers TP and TKCMY.

The degree of restriction on the amount of "transparent" toner in the toner layer TP is continuously tightened from a portion inward of the edge of the sheet P to the outer edge of the toner layer TP. Since the "transparent" toner is used for the purpose of exerting a glossy effect on the image, the "transparent" toner is formed in a solid form so as to cover the entire image. Thus, reduction of the amount of collected "transparent" toner contributes to minimization of shortening of the apparatus life to a large degree. In addition, the restriction on the amount of "transparent" toner from the portion inward of the edge of the sheet P negligibly affects the appearance of the image.

On the other hand, the degree of restriction on the amount of color toner in the toner layer TKCMY in the exemplary embodiment is continuously tightened from the edge of the sheet P to the outer edge of the toner layer TKCMY. Since the toner layer TKCMY of color toner naturally carries a visible toner image itself, excessively restricting the amount of color toner may affect the appearance of the image. Thus, in the exemplary embodiment, the degree of restriction on the amount of color toner in the toner layer TKCMY is made smaller than the degree of restriction on the amount of "transparent" toner in the toner layer TP. Such restriction contributes to minimization of shortening of the apparatus life and minimizes an adverse effect on the appearance of the image.

The exemplary embodiment has described, as a preferable example, an example in which the degree of restriction on the amount of use of color toner is different from the degree of restriction on the amount of use of "transparent" toner. However, an image forming apparatus according an exemplary embodiment of the invention may restrict the amount of use of color toner and the amount of use of "transparent" toner to the same degree.

This exemplary embodiment has described, as a preferable example, an example in which the degree of restriction on the amount of use of toner in the first region R1 illustrated in FIG. 3 is different from the degree of restriction on the amount of use of toner in the second region R2 illustrated in FIG. 3. However, an image forming apparatus according to an exemplary embodiment of the invention may restrict the amount of use of toner in the first region R1 and the amount of use of toner in the second region R2 to the same degree.

The exemplary embodiment has described, as a preferable example, an example in which the amount of use of toner is restricted in both of the inner region RIN and the outer region ROUT illustrated in FIG. 3. However, an image forming apparatus according to an exemplary embodiment of the invention may restrict the amount of use of toner only in the outer region ROUT.

The description has provided a printer as an example of the image forming apparatus according to the exemplary embodiment. However, an image forming apparatus according to an exemplary embodiment of the invention may be, for example, a copying machine or a multifunctional machine.

The description has provided a tandem color printer as an example of the image forming apparatus according to the exemplary embodiment. However, an image forming apparatus of the invention may be a revolver color printer or a black-and-white printer.

The description has provided an indirect transfer apparatus including an intermediate transfer belt as an example of the image forming apparatus according to the exemplary embodiment. However, an image forming apparatus according to an exemplary embodiment of the invention may be a direct transfer apparatus that directly transfers a toner image from image forming units of different colors onto a sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus, comprising:

an image forming device configured to form an image on a recording medium with a powdery material, the image being sized so as to extend beyond an edge of the recording medium;

a collecting device configured to collect the material that has extended off the recording medium as a result of the image forming device forming the image; and a restricting unit configured to control the image forming device in such a manner that the image forming device reduces an amount of use of the material in a region of the image that extends off the recording medium to a larger degree on an outer side of the image than a side of the image near the recording medium, wherein the restricting unit is further configured to restrict the amount of use of the material in an inner region and in an outer region and the amount of use of the material is restricted to a larger degree in the outer region than in the inner region, the inner region being located inward of the edge of the recording medium and the outer region being located outward of the edge of the recording medium, the inner region and the outer region being included in the region of the image that extends off the recording medium.

2. The image forming apparatus according to claim 1, wherein the material with which the image forming device forms an image includes a color material and a colorless material, and wherein the restricting unit is further configured to restrict an amount of use of the colorless material to a larger degree than an amount of use of the color material.

3. The image forming apparatus according to claim 2, wherein the image forming device is further configured to form the image on the recording medium while the recording medium is being transported, and wherein the restricting unit is further configured to restrict the amount of use of the material in a first region, which extends off the recording medium in a direction in which the recording medium is transported, to a larger degree than the amount of use of the material in a second region, which extends off the recording medium in a direction perpendicular to the direction in which the recording medium is transported.

4. The image forming apparatus according to claim 1, wherein the image forming device is further configured to form the image on the recording medium while the recording medium is being transported, and wherein the restricting unit is configured to restrict the amount of use of the material in a first region, which extends off the recording medium in a direction in which the recording medium is transported, to a larger degree than the amount of use of the material in a second region, which extends off the recording medium in a direction perpendicular to the direction in which the recording medium is transported.

5. An image forming apparatus, comprising:

an image forming device configured to form an image on a recording medium with a powdery material, the image being sized so as to extend beyond an edge of the recording medium;

a collecting device configured to collect the material that has extended off the recording medium as a result of the image forming device forming the image; and a restricting unit configured to control the image forming device in such a manner that the image forming device reduces an amount of use of the material in a region of the image that extends off the recording medium to a larger degree on an outer side of the image than a side of the image near the recording medium, wherein the material with which the image forming device forms an image includes a color material and a colorless material, and wherein the restricting unit is further configured to restrict an amount of use of the colorless material to a larger degree than an amount of use of the color material.

6. The image forming apparatus according to claim 5, wherein the image forming device is further configured to form the image on the recording medium while the recording medium is being transported, and wherein the restricting unit is further configured to restrict the amount of use of the material in a first region, which extends off the recording medium in a direction in which the recording medium is transported, to a larger degree than the amount of use of the material in a second region, which extends off the recording medium in a direction perpendicular to the direction in which the recording medium is transported.

7. An image forming apparatus, comprising:

an image forming device configured to form an image on a recording medium with a powdery material, the image being sized so as to extend beyond an edge of the recording medium;

a collecting device configured to collect the material that has extended off the recording medium as a result of the image forming device forming the image; and a restricting unit configured to control the image forming device in such a manner that the image forming device reduces an amount of use of the material in a region of the image that extends off the recording medium to a larger degree on an outer side of the image than a side of the image near the recording medium, wherein the image forming device is further configured to form the image on the recording medium while the recording medium is being transported, and wherein the restricting unit is further configured to restrict the amount of use of the material in a first region, which extends off the recording medium in a direction in which the recording medium is transported, to a larger degree than the amount of use of the material in a second region, which extends off the recording medium in a direction perpendicular to the direction in which the recording medium is transported.

* * * * *